US005125769A

United States Patent [19]

Lee et al.

[11] Patent Number: 5,125,769

[45] Date of Patent: Jun. 30, 1992

[54] FLOATABLE STRUCTURE

[76] Inventors: Kyu Lee, Room 201, 1-4-35 Nishiazabu, Minatoku, Tokyo, Japan; Ernst G. Frankel, 283 Buckminster Rd., Brookline, Mass. 02146

[21] Appl. No.: 641,674

[22] Filed: Jan. 16, 1991

[51] Int. Cl.[5] ..... E02B 17/02

[52] U.S. Cl. ..... 405/204; 405/207; 405/226; 114/264

[58] Field of Search ..... 405/195, 200, 203, 204, 405/205, 207, 209, 226; 114/264, 265

[56] References Cited

U.S. PATENT DOCUMENTS 2,352,370 6/1944 Carruthers ..... 405/204

4,094,162 6/1978 Allee ..... 405/204

4,167,148 9/1979 Fayren ..... 114/265

4,249,618 2/1981 Lamy ..... 405/204 X

*Primary Examiner*—David H. Corbin

*Attorney, Agent, or Firm*—Spensley Horn Jubas & Lubitz

[57] ABSTRACT

A structure that is floatable on a ocean surface and that is fixable relative to an ocean bottom. The structure includes an array of floatable, submersible caissons and a floatable box girder capable of supporting a modular superstructure. The box girder is floated to a position on the ocean surface above the submerged array of caissons. The array of caissons is then raised to engage and connect with the box girder. The caissons may also be secured to the ocean bottom.

13 Claims, 15 Drawing Sheets

FLOATABLE STRUCTURE

BACKGROUND OF THE INVENTION

1. Field of the Invention:

The present invention relates to a floatable structure, and in particular a floatable structure capable of supporting buildings such as airports, hospitals, hotels, industrial, commercial, or residential facilities and incorporating the systems necessary for the commercial or public use of such buildings.

2. Description of Related Art

Displacement Vessels

Floating vessels in the form of traditional single-hull ship or barge displacement vessels have been used to support industrial facilities such as cement plants, liquefaction equipment, storage and ship loading terminal/-facilities for natural gas. An example of such a single-hull ship or barge displacement-type vessel is disclosed in a publication entitled "Floating Cement Barge", published by Salen Technologies A.B., Goteburg, Sweden, Jun. 1984.

Displacement vessels in the form of floating barge support structures have consisted of longitudinally framed, girder-type steel vessels, as illustrated in FIG. 1. The internal structure of the floating hull is usually provided by one or more longitudinal bulkheads and three to six transverse bulkheads. They are usually designed as rigid structural floating girders, with a damage stability limit of one or two compartments. In other words, the structure will remain afloat and upright if no more than one or two transverse compartments are damaged. The structure of such barges is designed to sustain hydrodynamic and hydrostatic forces induced by surface effects such as waves, but not to forces transmitted through the ocean bottom. These structures are only designed for limited, floating operations.

The floatation and support structural functions are both provided by the barge vessel, which requires a large waterplane area to assure stability. This, in turn, causes large surface wave effects that cause undue large motions and forces or stresses on the floating barge girder structure. For example, shearing forces may be induced by a large heave motion, bending forces may be induced by a large pitch motion, hydrodynamic forces may be induced by a large heeling motion and hydrostatic forces may be induced by a large yawing motion. Consequently, unless such vessels are positioned in sheltered waters, they may experience severe motions and resulting structural loadings.

The wave loadings on such vessels, even in slightly exposed waters, impose a limit upon the size and industrial use of such vessels. Several floating, barge mounted airport, heliport, restaurant and hotel structures have been proposed or built since approximately 1956. A primary disadvantage of these facilities is that they are subject to severe wave, current, and other water surface effects and can only be employed in very sheltered waters.

It has been proposed that single hull displacement barge mounted structures be employed as gravity caissons or box structures which can be sunk or lowered by gravity to the ocean bottom and which may be supported on the ocean bottom after sinking. An example of a single hull displacement barge mounted structure employed as a gravity caisson or box structure is shown in FIGS. 2*a* and 2*b*. Because of its large waterplane area, such a box support structure will be subjected to severe water surface effects which impose severe forces on such a facility support structure when exposed to wave action. The unevenness of the soil at the ocean bottom may induce major bottom induced stresses on such a gravity structure, which would not be uniformly supported by the ocean bottom.

In an attempt to reduce longitudinal force induced stresses, it has been proposed that the barge or box structures be provided with hinges or couplings. As illustrated in FIG. 3, these hinges or couplings are designed to allow several barge or box-type floating structures to be linked together to form a larger support structure with reasonable shear stresses and bending moments. However, large induced vertical, torsional, yaw, and pitch forces and moments make this type of joining inefficient, very expensive, or infeasible.

With the exception of the hinged barge or box supported facilities (which can be joined at their final operating location by connecting separately floating boxes or barges), the displacement vessels described above must be constructed and completely erected at a shipyard or other facility and positioned as complete units. The superstructure load cannot be floated onto the floating foundation at the site or elsewhere.

Semi-Submerged Vessels

Another known vessel, in use since approximately 1962, consists of a twin-hull, semi-submerged vessel. Such vessels have been applied in offshore exploration, construction, pipe laying, and drilling. These vessels are usually designed to be self-propelled and/or self-positioning. The vessels are supported by twin, near-surface submerged displacement vessels connected to an above surface working platform by vertical cylindrical or faired surface piercing struts. An example of such a vessel is disclosed in the publication entitled "1986 Annual Report" published by Hyundai Heavy Industries, Shipbuilding Division, Ulsan, South Korea.

In recent years, small self-propelled semi-submerged catamaran vessels, also call SWATH (Small Water Area Twin Hull), based on the same design principles, have been built for commercial ship use. These vessels are quite stable and can operate in exposed waters, but they are not capable of being placed on the ocean bottom.

Column-stabilized, semi-submerged ships or platforms, in which the payload or working platform is connected to twin submerged displacement vessels by vertical columns, have been suggested for use as helicopter or aircraft carriers or floating air fields. See the publication entitled "Semi-submerged Catamaran--SEMCAT", Report No. 13-07-64, published by the Department of Naval Architecture and Marine Engineering, MIT, Cambridge, Mass. 02139. Major floating stable platforms were investigated from a structural point of view at various universities and government laboratories in the late 1960's.

Semi-submerged ships or platforms typically consist of two submerged cylindrical or box-type vessels with faired bows and stern made of steel and internally framed by transverse ring webs and subdivided by transverse bulkheads. These cylindrical vessels, usually operating at depths in excess of the prevailing wave heights, are connected to the above surface payload or working platform by vertical faired water surface piercing struts built of steel with internal stiffeners. An example of the structural connections is illustrated in FIG. 4, which also indicates the placement of the struts on the below surface cylindrical vessels. When the spacing between the cylinders and/or the length of the struts is large, cross braces are often introduced for structural integrity.

It has been proposed that column-stabilized platforms could be used for deep ocean airfields and a variety of ocean research and engineering support activities.

Work at the University of Hawaii in more recent years concentrated on developing the concept of a floating city, an outgrowth of the U.S. Navy's Mobile Ocean Basing Study (MOBS) performed with ARPA support. The concepts are based on linked floating pontoon structures with column supported superstructures.

In 1974, based largely on this work, the Japanese built a demonstration floating city module, called Aquapolis, for the Okinawa World Fair. In more recent years, Japanese investigators have continued efforts in this area, including a design study for a 5×7.5 km floating "information" city. This design concept would share technical similarities with the MOBS/Hawaiian floating cities concepts by using small waterplane area buoyancy modules and dynamic ballasting techniques, as shown in the publication entitled "Okinawa World Fair Bulletin", published by the Okinawa Municipal Authority in 1974. Yet again this concept can only be applied under floating conditions and in fairly sheltered waters. Additional recent work, based on floating barge supports, includes a 1969 floating airfield design called FLAIR by Weidlinger, more recent designs by Bechtel Corporation for Kumagai Gumi of Japan and the design of a Short Take-off and Landing Floating Airport (STOLPORT) for the North Sea developed by the Seaforth Maritime Ltd. of Aberdeen, Scotland. The above-referenced prior art designs are generally based on rectangular superstructures supported on floating/-floatable barge or box-type foundations, or large connected floating barge/box-type structures such as those shown in the publication entitled "Report on the Design of a Floating Airport" by P. Weidlinger, New York, N.Y., Sept. 1969 - 090069.PW.

In the early 1980's the U.S. Navy initiated related work at the Navy Engineering and Construction Laboratory (NECL) and the David Taylor Research Center (DTRC) in the Deployable Floating Waterfront Facilities Program (DWP). in 1986, the Naval Ocean Systems Center (NOSC) suggested that it would be beneficial to consider a national effort using existing technology to develop major stable floating platforms as alternatives to overseas land bases. Although some theoretical research in the field of large column stabilized platforms was accomplished, no applications of the research results were advanced, and none of the concepts considered were designed for both floating and bottom supported operations, and for floating or erection and assembly at the site.

Rigid Structures

Tower-type structures, such as those disclosed in the publication entitled "Oil and Gas Journal", Sept. 1979, have been designed and installed on prepared ocean bottom sites for oil drilling or production. These rigid structures are not displacement-type structures and must be fully erected before lowering to the ocean bottom. The ocean bottom itself must meet certain level, load-bearing, and other requirements. Tower-type offshore structures cannot be floated in place but must be transported by barge to the site. They are also not readily relocatable. Tower structures may also be built as jack-up structures or platforms which typically consist of a barge platform carrying four extractable or jack-up structural legs. When the platform is floating at the desired location the legs are extended until they hit bottom. They are then further extended to elevate the barge-type platform by the desired clearance or distance above the water.

Jack-up platforms can be placed on uneven ocean bottoms by differential extension of the jack-up legs. The legs are usually equipped with spuds and bearing plates to distribute the bearing loads and to assure better holding against lateral forces.

The above-described prior art structures are designed for full erection at the construction site and operation as a floating facility. Large bottom supported oil exploration and drilling platforms are the only prior art structures designed for floating in place and bottom supported operations.

The above-described prior art structures suffer from a number of disadvantages when used as facility support structures. Some of these disadvantages are discussed below.

The prior art barge, semi-submerged catamaran and column stabilized platform structures are displacement vessels that are designed to support a payload by floatation. They are capable of floating operations only. They cannot be floated in place and sunk. They are structurally incapable of resting on an ocean bottom (regardless of how even that ocean bottom may be) and sustaining bottom or foundation induced forces The prior art structures cannot be erected at site in terms of placement of the superstructure load on a foundation, as the barge or semi-submerged support structure must remain afloat and surface piercing for stability. They are structurally incapable of being sunk to the bottom for erection of the payload.

The prior art structures are subject to severe wave loading when operating in open waters, both on the floating barge or near surface cylindrical displacement vessels.

The prior art structures are difficult to moor and maintain in position, in both shallow and deep water.

The prior art structures are designed for particular environmental conditions, such as particular ocean depths and surface effects, and are structurally incapable of working under non-design conditions.

The prior art structures are designed to be either operated in fully floating condition (with or without anchoring) or to be placed on the ocean bottom (as in the case of tower and similar platforms). Floating platforms are not designed to be supported on the ocean bottom. Tower and similar platforms are not designed to operate under floating condition.

It is an object of the present invention to provide an integrated, fully equipped floating or floatable, prefabricated, relocatable service facility which can be erected at an offshore site and used either as a floating facility or as a bottom supported facility.

It is another object of the present invention to provide a multi-level structure for use as an airport, industrial, or commercial facility or the like and on which can be erected unique A-frame type modular superstructures for various types of uses supported on an original modular stabilized caisson base support structure, which can be floated in place connected to other such supported modules and after assembly operated in a floating or gravity condition, without being subjected to large detrimental water or wave surface effects, or penalized by poor, soft and/or uneven ocean bottom soil conditions when operated in a gravity condition, and placed on or supported by gravity on the ocean bottom.

It is a further object of the invention to provide simple prefabrication assembly and outfitting, thereby reducing construction time and cost, ease of positioning and relocation if necessary, economies in use of steel and concrete construction materials, outfitting, and other costs, flexibility in layout, use and reuse, and economy in site preparation and use.

SUMMARY OF THE INVENTION

In accordance with the present invention, these and other objectives are achieved by providing a submersible array of caissons capable of supporting a box girder. The box girder is in turn designed to support a modular superstructure. The box girder and/or superstructure can be constructed independently and then floated to and erected on the submerged caisson array at the operating site or elsewhere. The box girder and/or superstructure can be erected on the floating caisson array after its launch, and therefore requires little if any shipyard or large construction facility support.

In a preferred embodiment of the invention, the caissons may be made of concrete or steel and may incorporate storage and service systems for fuel, fresh water, etc. The caissons may also incorporate anchor piles and anchor skirts for maintaining the position of the caissons when the caissons are lowered to the ocean bottom. These protruding anchor skirts may be designed to permit the introduction of pressure equalizing and leveling material between the bottom of the caissons and the uneven ocean bottom surface. This enables the ocean bottom to be leveled and hardened before the caissons are finally positioned, thereby permitting the caissons to be supported on an ocean bottom surface that has a varying load-bearing capacity.

The modular superstructure may be structurally incorporated on the box girder. The modular superstructure/box girder may include several levels. Transport, utility (fuel, water, ventilation, etc.), service, and communication systems may be placed on separate levels under the facility main deck or surface, thereby allowing the vertical separation of these functions from top or main deck functions. For example, if the present invention is used in conjunction with an airport, then the top or main deck functions might include aircraft operations such as parking, take-offs and landings. The lower level functions could be provided directly under the main deck and could include baggage handling, cargo movement, aircraft maintenance and supply, and passenger handling. Each of these functions could use a separate level, with vertical access being provided to and from aircraft on the main deck.

Similar objectives can be achieved when the invention is applied for other purposes, such as floating/floatable hospitals, industrial facilities, and more.

The floatable structure of the present invention may be located in coastal waters, inland waters, or at sea. It can serve as a stand-alone structure or be joined or linked with several other similar structures.

BRIEF DESCRIPTION OF THE DRAWINGS

A detailed description of preferred embodiments of the invention will be made with reference to the accompanying drawings, wherein like numerals designate corresponding parts in the several figures.

DESCRIPTION OF THE PREFERRED EMBODIMENTS

The following detailed description is of the best presently contemplated mode of carrying out the invention. This description is not to be taken in a limiting sense, but is made merely for the purpose of illustrating the general principles of the invention. The scope of the invention is best defined by the appended claims.

Figure 7:
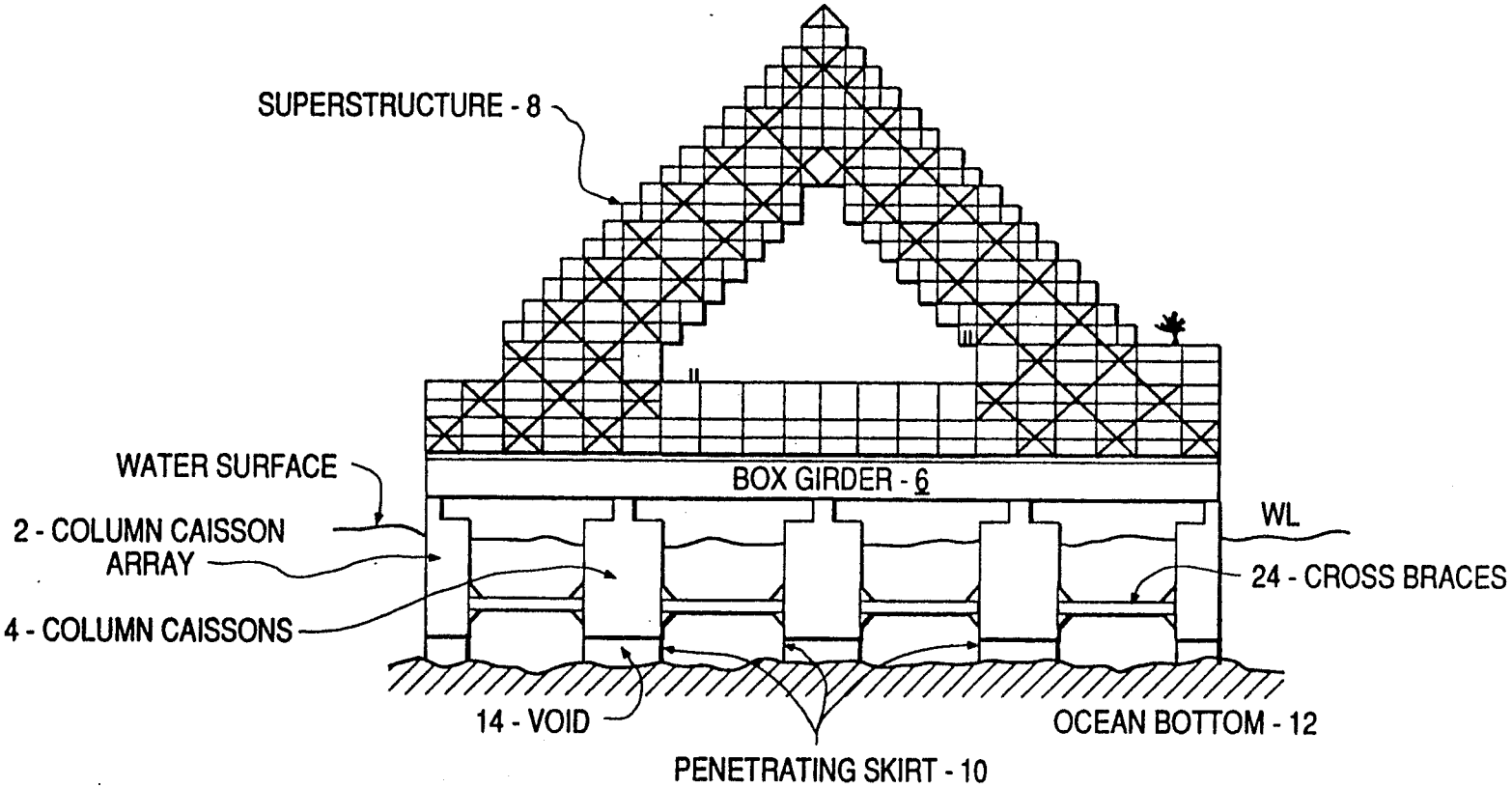
FIG. 7 shows a transverse section of a superstructure supported on a box girder and an array of column caissons that have been floated up from the ocean bottom toward the water surface to meet with and engage the box girder.
Figure 8:
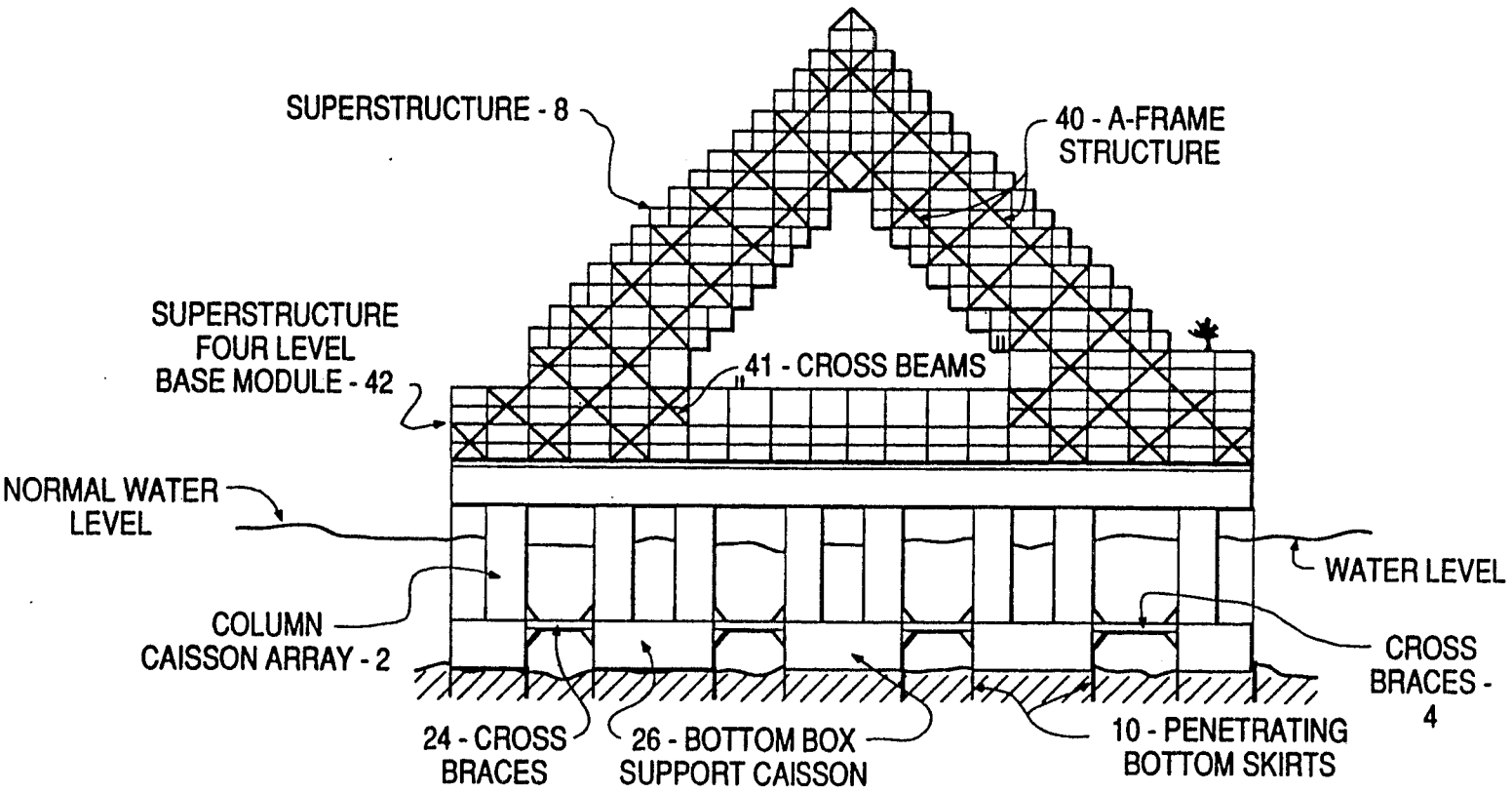
FIG. 8 shows a transverse section of a floatable column array on submerged box caissons, used as a floating or gravity support system, placed on the ocean bottom as shown, after placement and connection of the box girder supporting the superstructure.
Figure 9:
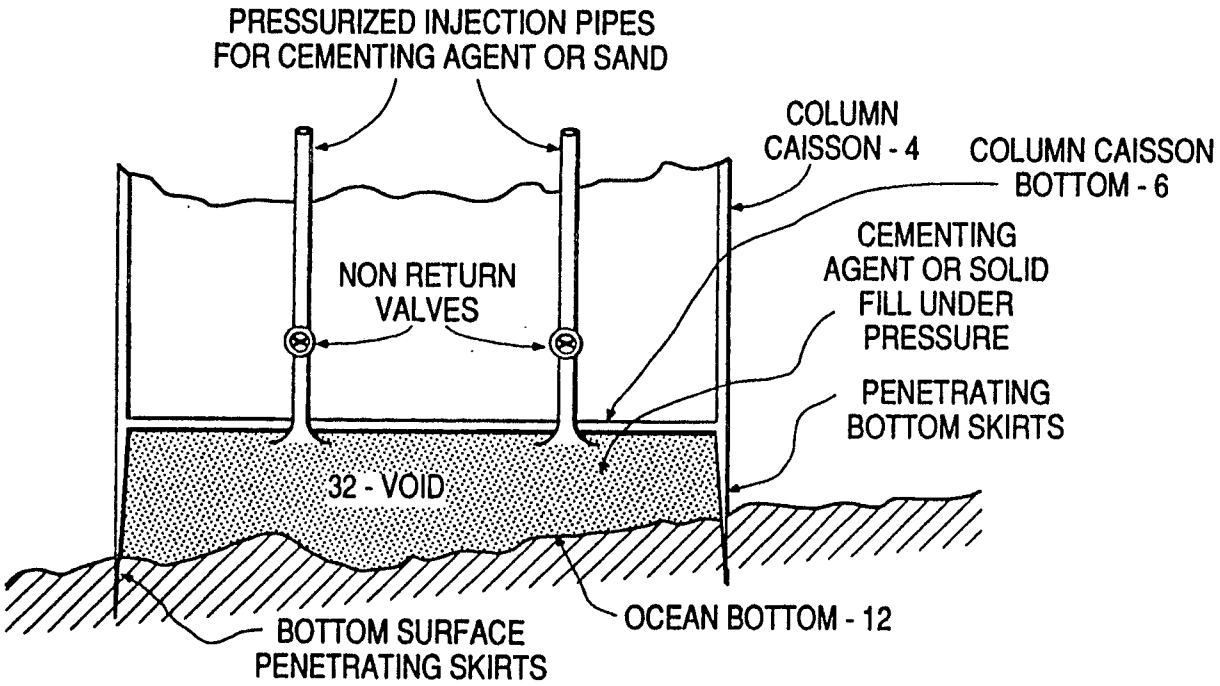
FIG. 9 shows details of a column of a caisson support system with a bottom penetrating skirt and the under caisson leveling and support distributing void.

As shown in FIG. 7, a preferred embodiment of the present invention includes a foundation comprising an array 2 of interconnected floatable or submersible stabilized support column caissons 4. The caisson array 2 is designed to support a box girder 6. The box girder 6 provides the structural interconnection between the caisson array 2 and a superstructure 8. Although referred to in herein as a "box" girder, it will be apparent to those skilled in the art that the girder 6 need not take the shape or form of a box but may assume any of a wide variety of shapes and forms, all of which fall within the scope of the present invention.

The column caissons 4 are preferably both floatable and submersible. The column caissons 4 may, for example, be made of steel or reinforced concrete. While the column caissons 4 shown in the illustrated embodiments are cylindrical, it will be apparent to those skilled in the art that the column caissons need not take the shape or form of a cylinder but may assume any of a wide variety of shapes and forms, all of which fall within the scope of the present invention.

Each of the column caissons 4 of the caisson array 2 may be equipped with a penetration skirt 10. The penetration skirt 10 is designed to penetrate the surface of the ocean bottom 12 and to provide a closed void 14 between the bottom 16 of the column caisson 4 and the ocean bottom 12. The penetration skirt 10 preferably consists of a wall of sharpened steel plate approximately three feet to six feet in length. The penetration skirt 10 may be provided in a variety of lengths, depending primarily upon the expected soil conditions on the ocean bottom 12 as well as the degree of unevenness on the ocean bottom.

If the array 2 is intended for use as a floating support system only, then the penetration skirts 10 may not be required. Similarly, if a prepared, leveled and compacted ocean bottom surface is available at the location at which the structure is to be placed, then the penetration skirts 10 may not be required.

Figure 13:
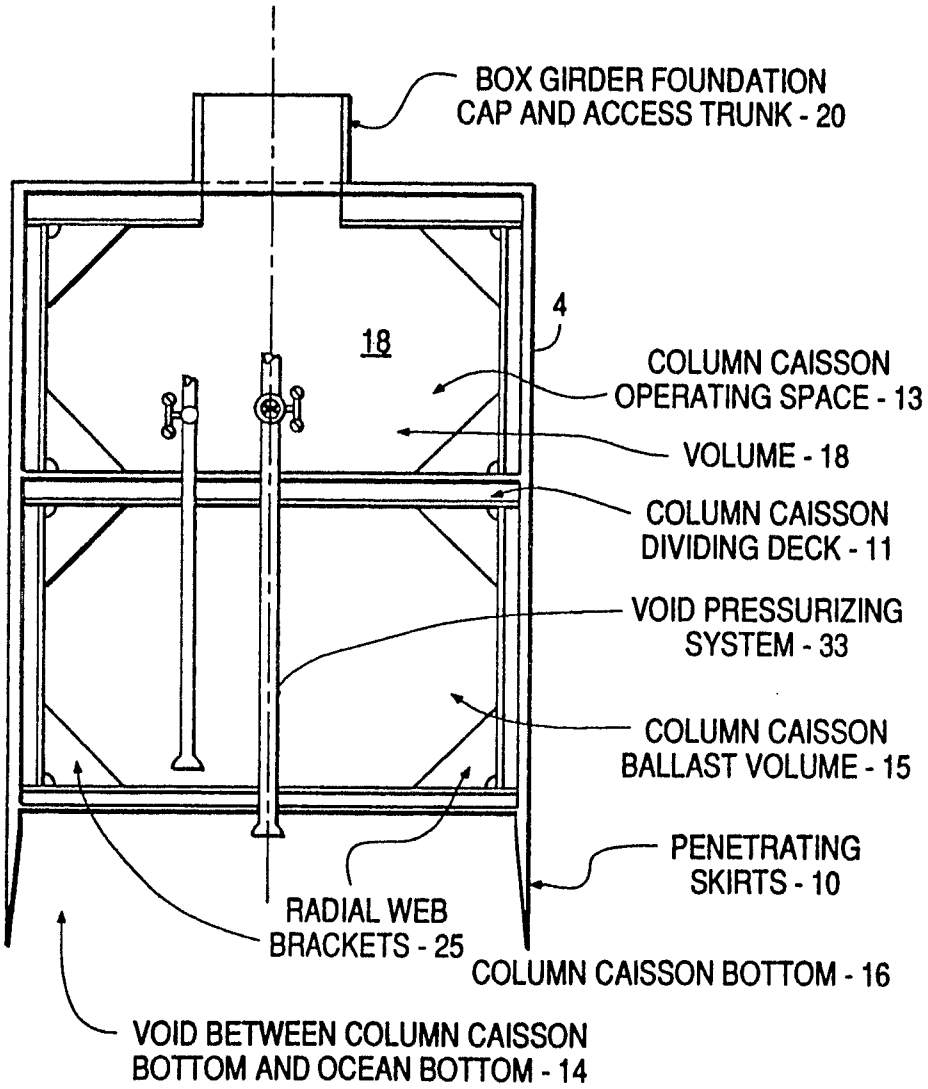
FIG. 13 shows the volume within a column caisson being used for ballasting or for containing various liquids or other materials.

The volume 18 within each column caisson 4 may be used for ballasting or for containing various liquids or other materials, as shown in FIG. 13. The volume 18 in the column caisson 4 may also contain a leveling void pressurizing system 33.

The void pressurizing system 33 may consist of a slurry pump with associated sand, premixed concrete, or other slurried fill and a suction system that allows the slurry pump to pump the slurried fill into the void below the column caisson 4 (or the void below a box caisson 26, as described below). After the withdrawal of surplus water from the void or after the slurried fill has reached its desired density, the void pressurizing system is capable of pressurizing the void, whereby the void is filled and the bottom of the column caisson 4 (or the box caisson 26) is elevated to a level which assures both that the supported structure is substantially horizontal and that the pressure under all of the column caissons 4 (or box caissons 26) is equalized.

Each of the column caissons 4 of the array 2 is preferably equipped with a cap 20. The cap 20 provides a connection with and access to the box girder 6 that supports the superstructure 8. In a preferred embodiment of the invention each of the caps 20 is approximately six to twelve feet in diameter. Each cap 20 preferably provides a vertical trunk for accommodating a variety of services such as pipelines, cables, ventilation trunks, stair and elevator trunks and more.

The caps 20 located on the tops of the column caissons 4 are configured to be received by corresponding recesses 22 in the box girder 6. The box girder 6 is designed to rest or be placed upon the caps 20 of the array 2 of the column caissons 4, as shown in FIG. 7. The superstructure 8 mounted on the box girder 6 can be floated to a position directly above the submerged array 2 of column caissons 4. After the column caissons 4 are deballasted, the array 2 of column caissons 4 will float upward and may be guided and positioned so that the caps 20 mate with the corresponding recesses 22 in the box girder 6. The array 2 of column caissons 4 may be attached to the box girder 6 by welding.

Figure 15:
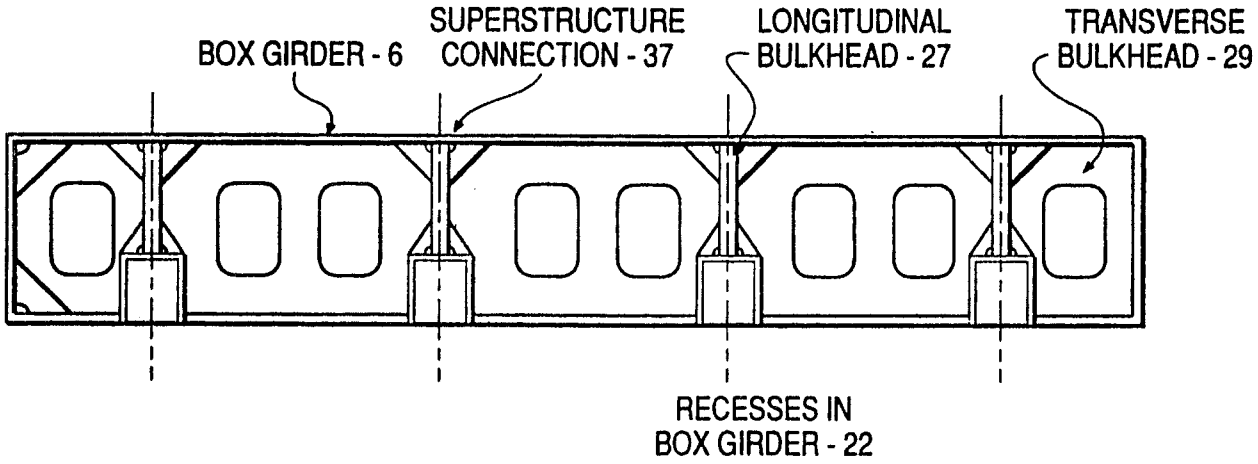
FIG. 15 shows a box girder.

As shown in FIG. 15, the box girder 6 preferably is a floatable steel barge structure equipped with steel trunks to match with the caps 20 on top of the column caissons 4. The box girder 6 is preferably designed as a steel barge with longitudinal bulkheads 27 and transverse bulkheads 29 and internal stiffening, and is designed to operate as a floating barge or structural column supported girder. The volume in the box girder 6 can be used for various storage, machinery, or other functions.

Figure 10:
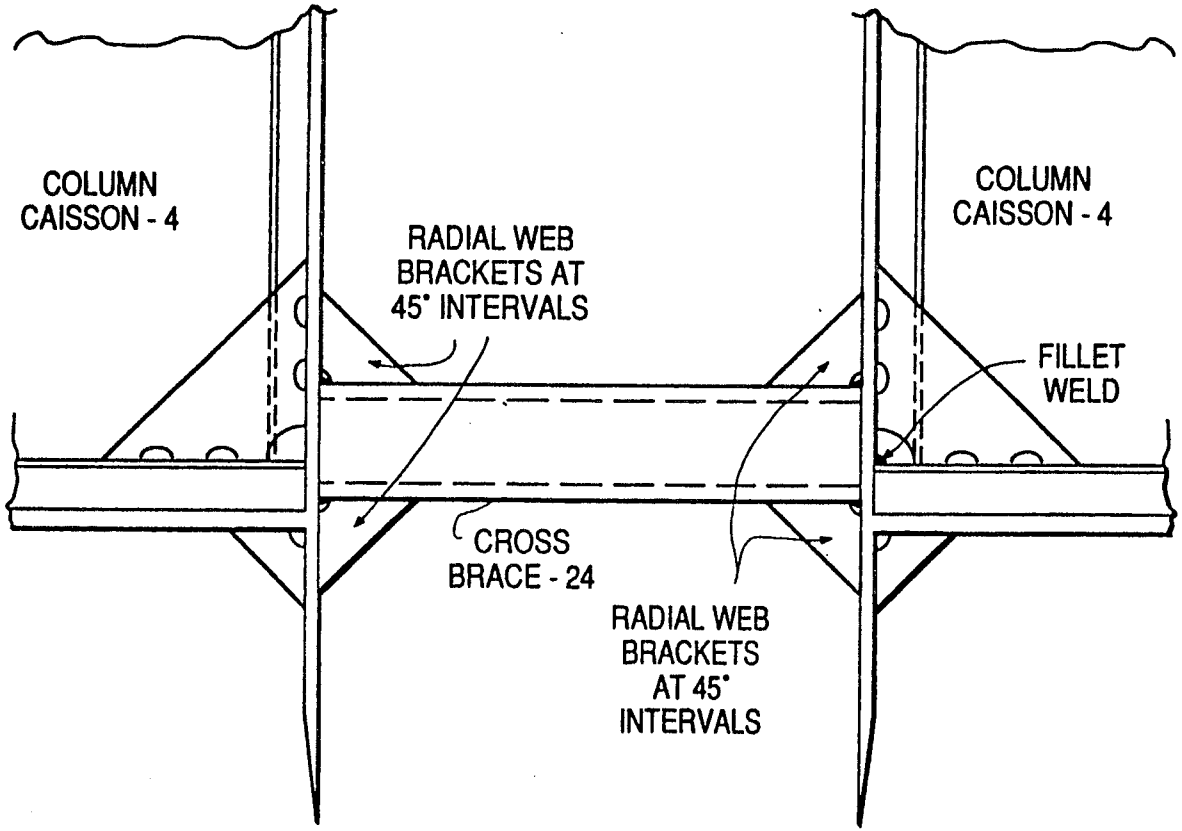
FIG. 10 shows cross braces attached to column caissons by flange connections with radial web brackets.

The array 2 of column caissons 4 may be stiffened by interconnected cross braces 24. If the column caissons 4 are made of steel, then the cross braces 24 may comprise tubular steel welded onto the steel column caissons. Alternatively, for column caissons 4 made of reinforced concrete, the cross braces 24 may be attached to the column caissons 4 by flange connections 23 with radial web brackets 25 at forty five degree intervals, as shown in FIG. 10.

Figure 6:
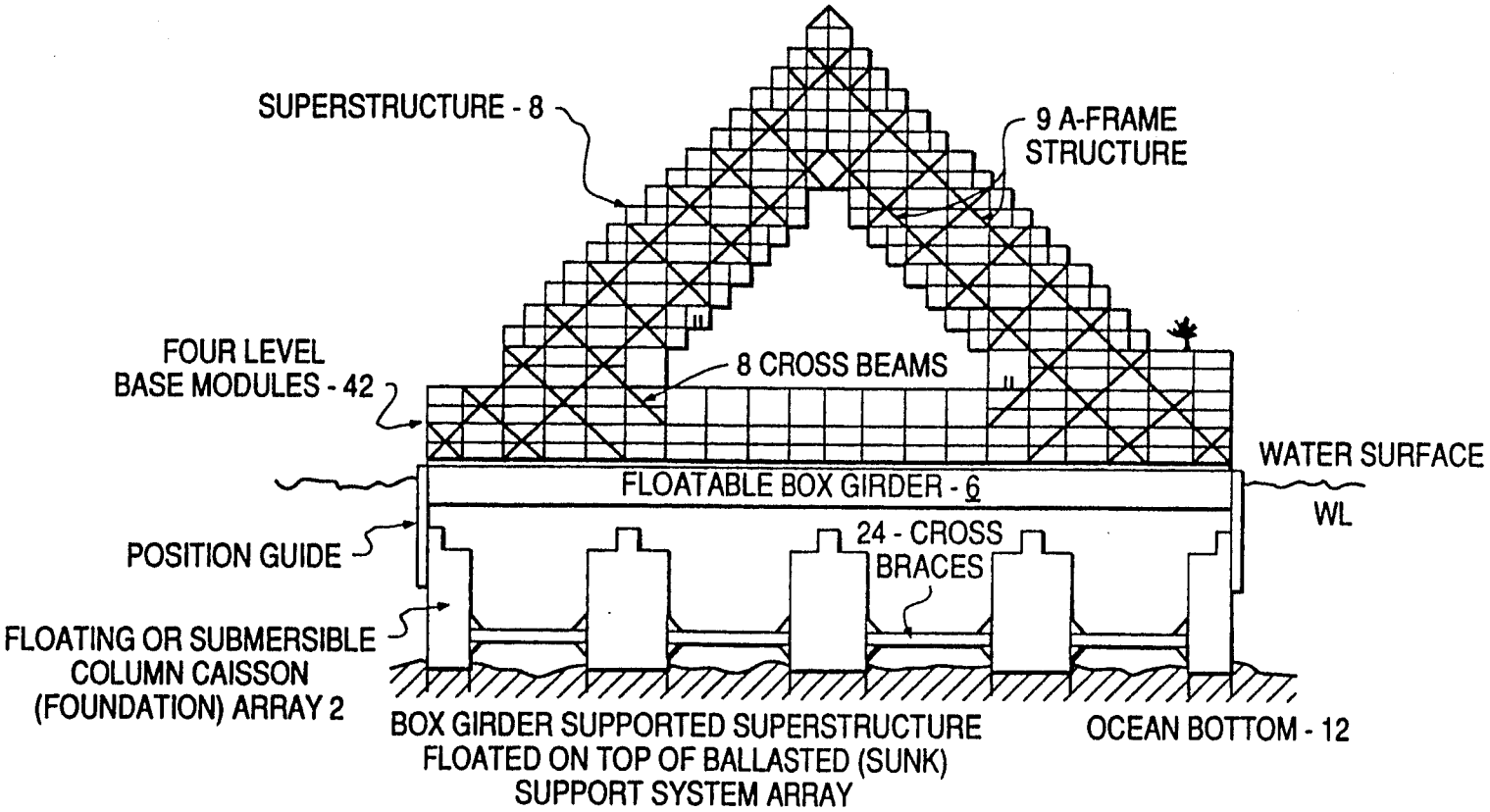
FIG. 6 shows a transverse section of a superstructure supported on a box girder and an array of column caissons on the ocean bottom.

FIG. 6 shows a transverse section of the floating/-floatable superstructure 8 supported on a box girder 6 after the column caissons 4 have been placed on the ocean bottom 12 but before the box girder 6 has been positioned on the array 2 of column caissons.

FIG. 7 shows a transverse section of the floating/-floatable superstructure 8 after the array 2 of column caissons 4 has been floated up to connect with the floating box girder 6 and the box girder 6 has thereby been elevated above the surface of the water.

Figure 14:
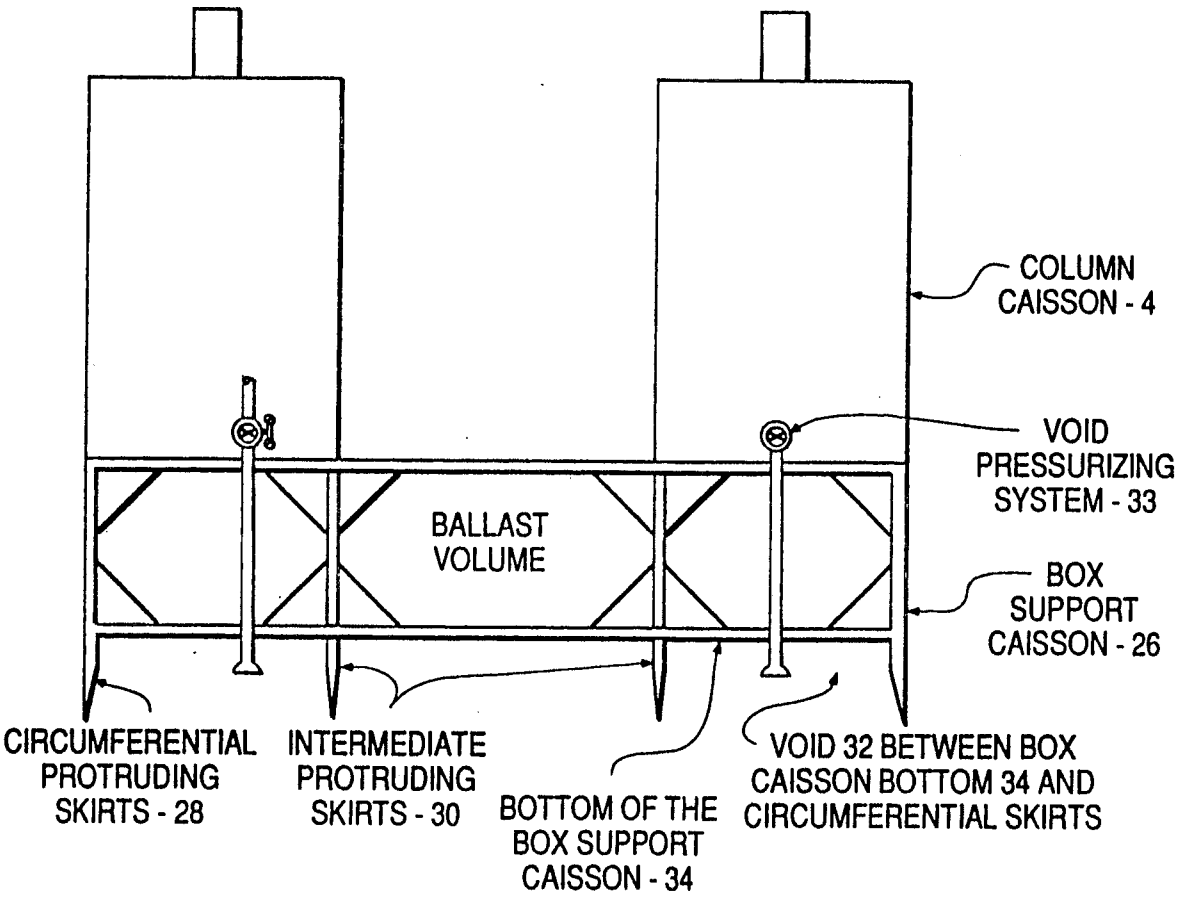
FIG. 14 shows a box support caisson designed to join together several column caissons.

FIG. 14 illustrates an embodiment of a box support caisson 26 designed to join together several of the column caissons 4. The box caisson 26 may be used if the floatable support structure is intended to be placed on the ocean bottom 12, or if a relatively larger submerged displacement volume is required to support a load. In the embodiment illustrated in FIG. 14, the box caisson 26 is designed to join together four of the column caissons 4. The box caisson 26 provides more effective footing as well as larger displacement.

The box caisson 26 is preferably made from internally stiffened steel or reinforced concrete. The column caissons 4 may be welded onto the box caissons 26 if both the column caissons and the box caissons are made of steel. Alternatively, the column caissons 4 may attached to the box caissons 26 by flanges and couplings.

As illustrated in FIG. 14, the box caisson 26 may be equipped with circumferential protruding skirts 28 and intermediate protruding skirts 30. Both the circumferential protruding skirts 28 and the intermediate protruding skirts 30 may be made of steel. The intermediate protruding skirts 30 may be perforated. The void 32 between the bottom 34 of the box caisson 26 and the circumferential skirts 28 may be pressurized or filled with water or sand. The volume 36 within the box caisson 26 may be used for ballasting and deballasting.

The lower volume in the column caisson 4 and the entire volume in the box caisson 26 may be employed for ballasting by providing both ocean water filling and discharging pumping facilities. These pumping facilities may be designed to permit the controlled sinkage and floatation of the column caissons 4 or the arrays 2 supported by the box caissons 26 for both erection and operational requirements. As a result, the structure could be controlled when in a floating condition. Similarly, the amount of pressure on the ocean bottom could be controlled by ballasting when the structure is placed or supported on the ocean bottom when operating.

In a preferred embodiment, the circumferential steel skirts 28 are approximately ten to thirty feet in length. The circumferential skirts 28 are particularly useful when soil conditions on the ocean bottom 12 are highly irregular and the structure is consequently difficult to level, or when soil on the ocean bottom is soft, semi-liquid, or compressible. The circumferential skirts 28 are designed to penetrate the ocean bottom 12 to both help retain the position of the lowered column array 2 or box caisson array, and to provide a void 38 between the bottom 40 of the foundation and the column caissons 4 or box caissons 5.

Hardening cementing agents or sand mixtures can be pumped into this void 38 to equalize and level the bottom and to spread the load over the whole bottom 40 of the column caissons 4 or the box caissons. The injected cementing agent and/or sand is preferably maintained under pressure until it is compacted or settled, thereby providing effective load distribution over the bottom 40 of the array 2 of the caissons 4. A pressurizing system may also be used to assist in leveling the array 2 on an uneven ocean bottom 12.

If the array 2 is intended for use as a floating support system only, then the skirts 28 and 30 may not be required. Similarly, if a prepared, leveled and compacted ocean bottom surface is available at the location where the structure is to be placed, then the bottom skirts 100 may not be required.

Figure 1A:
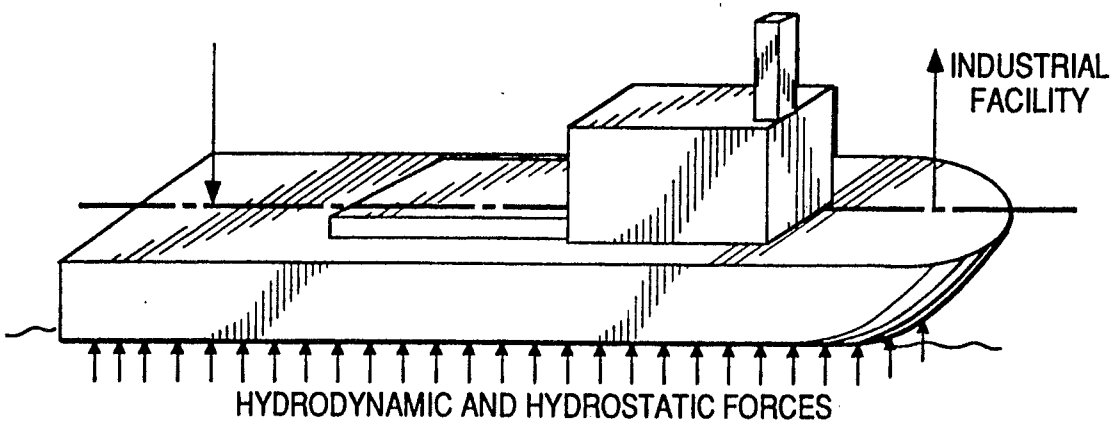
FIGS. 1*a* and 1*b* show displacement vessels in the form of floating barge support structures consisting of longitudinally framed, girder-type steel vessels.
Figure 1B:
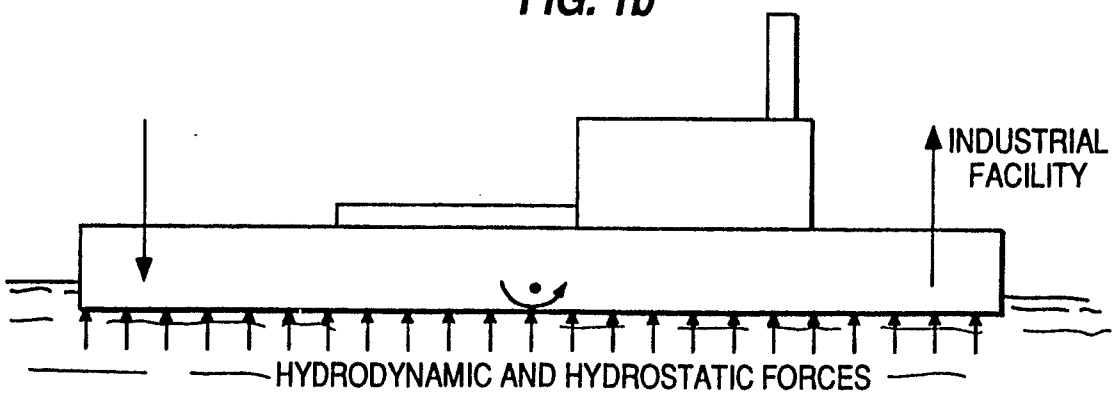
Figure 2A:
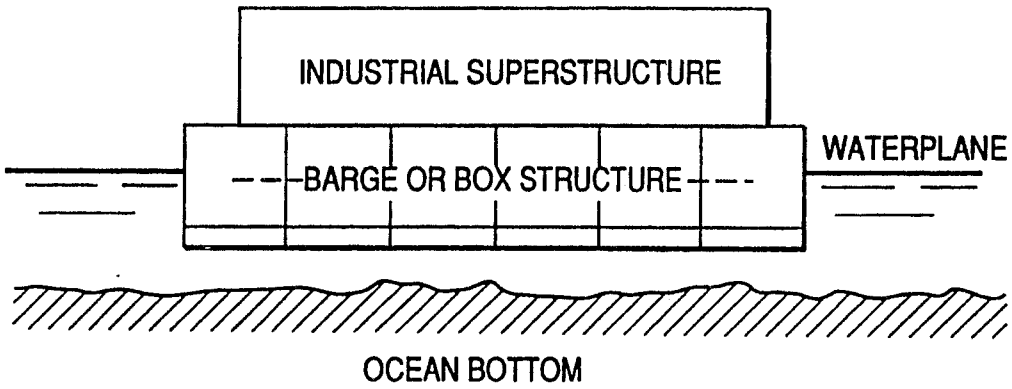
FIGS. 2*a* and 2*b* show an example of a single hull displacement barge mounted structure employed as a gravity caisson or box structure.
Figure 2B:
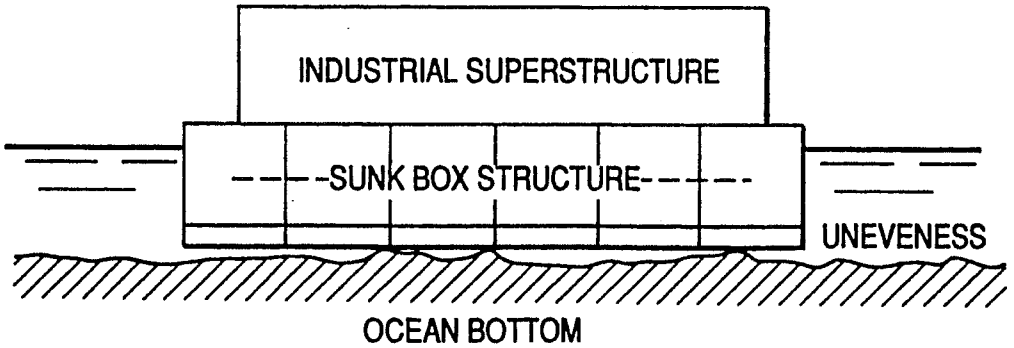
Figure 3:
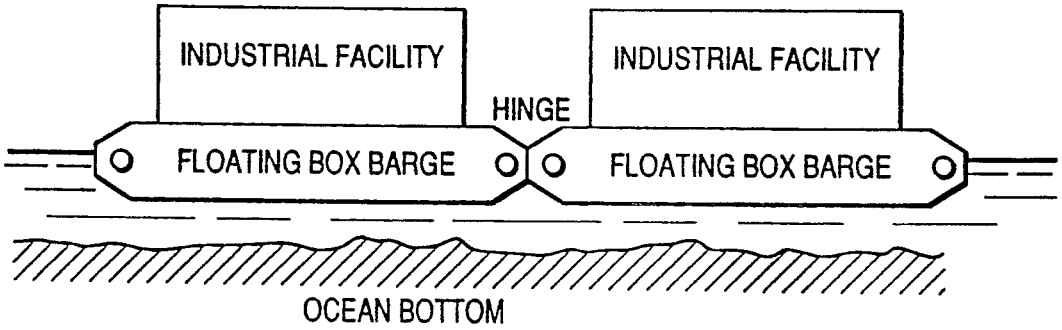
FIG. 3 shows hinges or couplings designed to allow several barge or box-type floating structures to be linked together to form a larger support structure.
Figure 11:
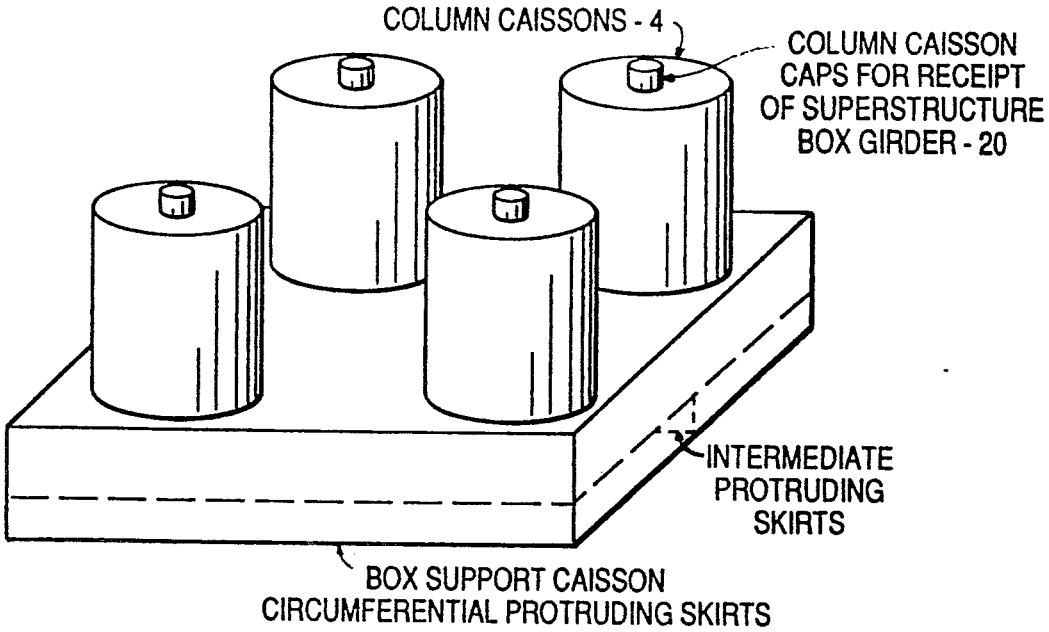
FIG. 11 shows subarrays of four column caissons placed on box caissons.
Figure 4:
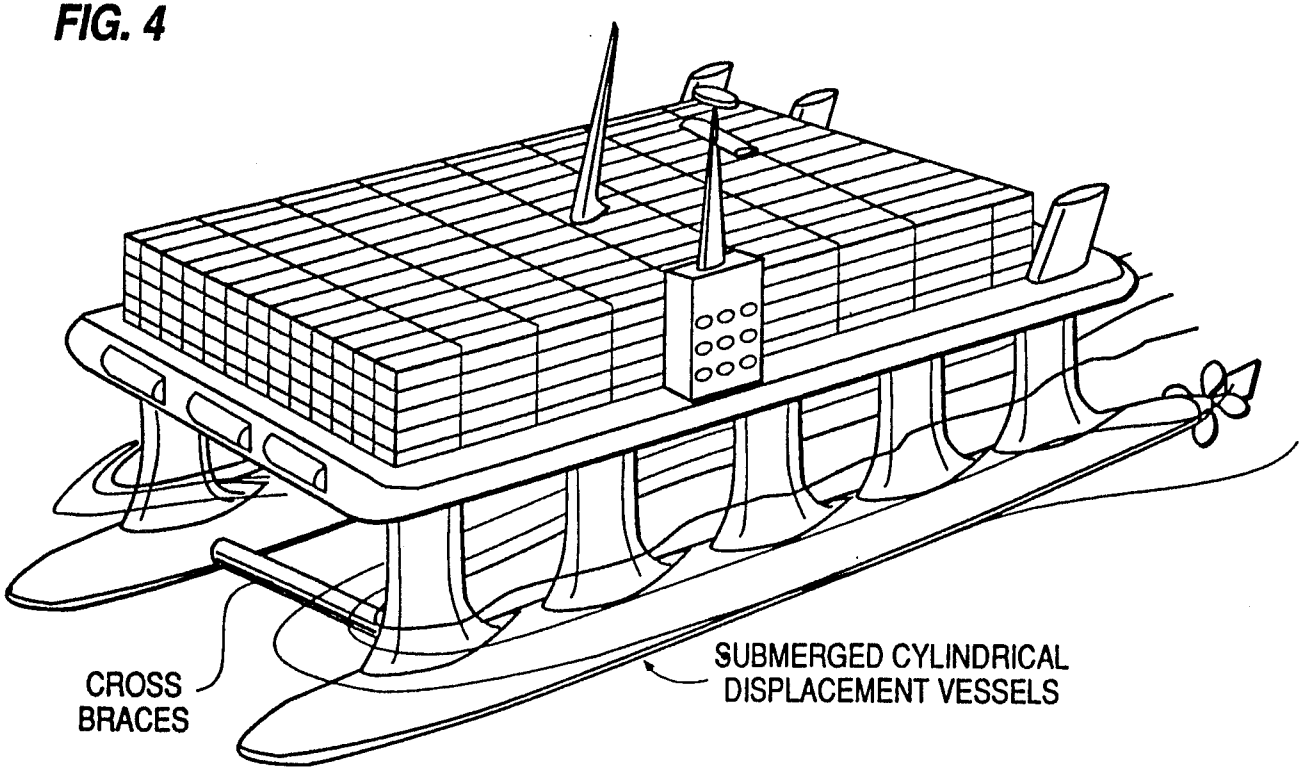
FIG. 4 shows a below surface cylindrical vessel connected to an above surface payload or working platform by vertical faired water surface piercing struts built of steel with internal stiffeners.
Figure 5A:
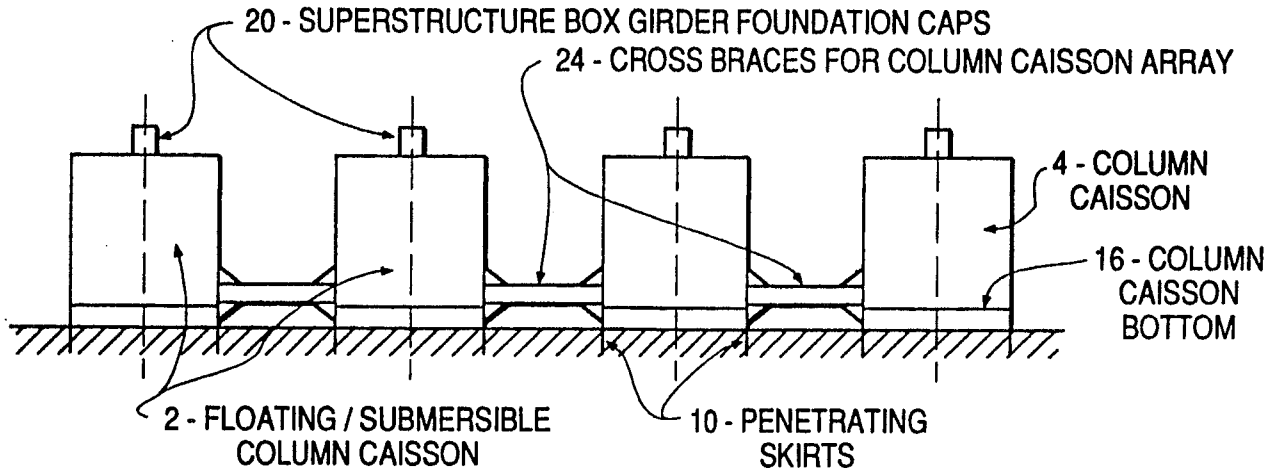
FIG. 5*a* shows a floatable array of column caissons.
Figure 5B:
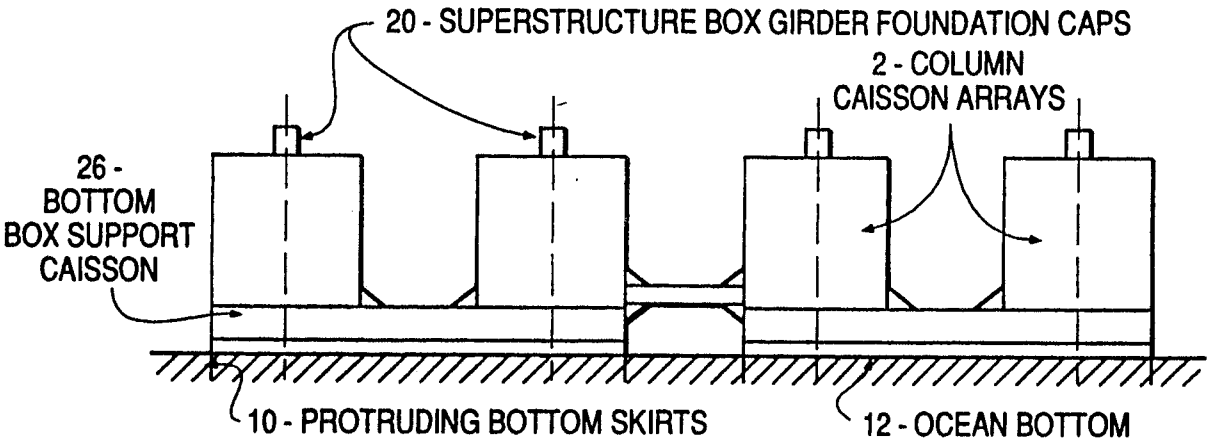
FIG. 5*b* shows a floatable array of column caissons with bottom box support caissons.

If box caissons 26 are used to support the column caissons 4, then it is possible that the cross braces 24 need only be applied between groups of supported column caissons 4. In that case, subarrays of four column caissons 4 may be placed on the box caissons 26 as shown in FIG. 11, with both longitudinal and transverse cross braces 24.

Figure 16:
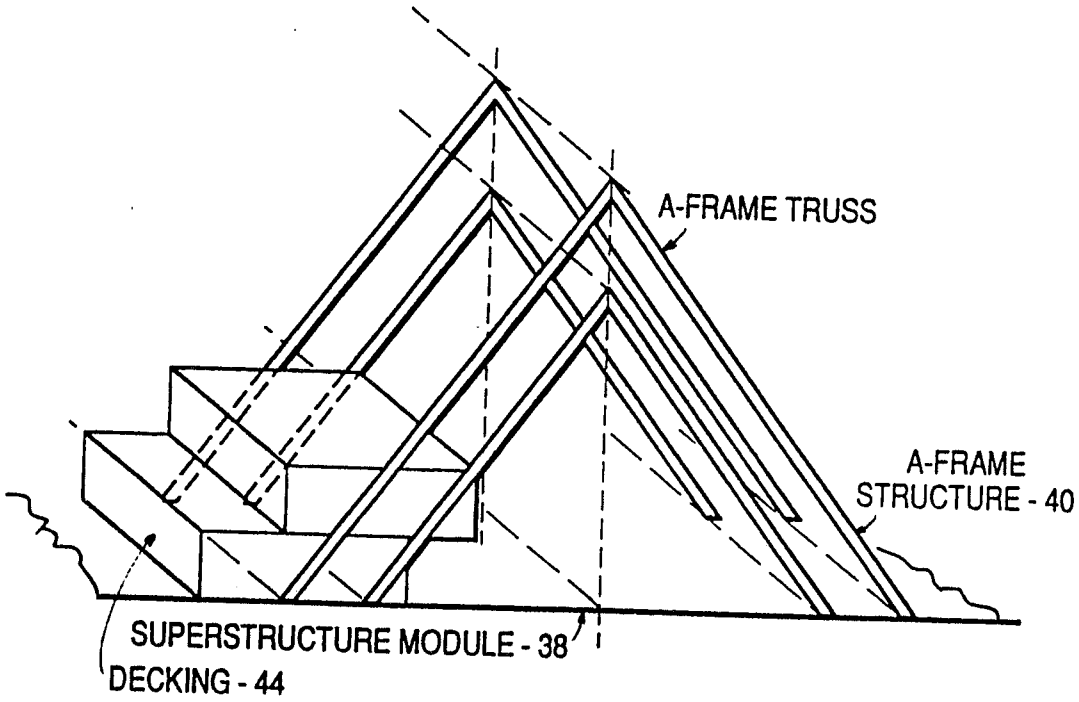
FIG. 16 shows a steel A-frame superstructure with cross beams which support and integrate superstructure modules.

The superstructure 8 is preferably a flexible modular frame superstructure that may be stabilized by one or more large A-frame structures 40 and cross beams 41. The cross beams 41 support and integrate the superstructure modules 38, as shown in FIG. 16. The A-frame 40 and cross beams 41 are preferably made of large I-beams connected by pin joints and supported on the base modules 38 by flanges. The superstructure 8 rests on a multilevel base module 43 that is supported on the rigid floatable box girder 6.

Figure 12:
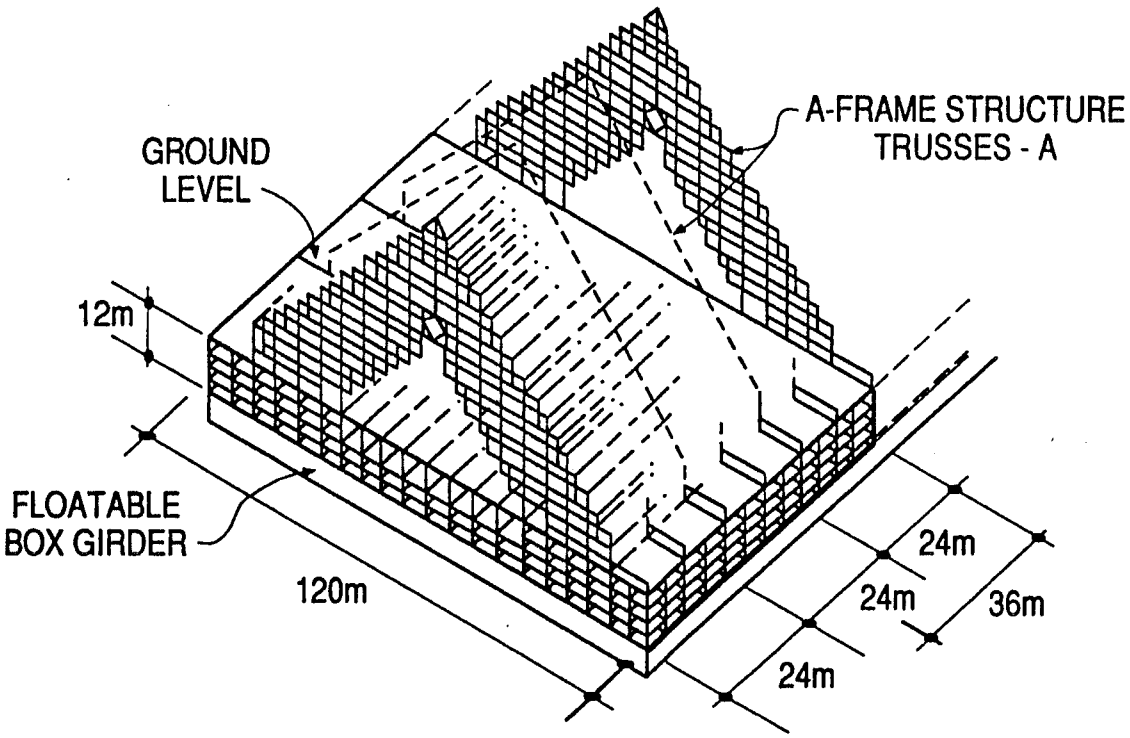
FIG. 12 shows an isometric perspective illustrating the assembly of several superstructure modules and an A-frame structure on a four-level base placed on a floatable box girder.

FIG. 12 shows an isometric perspective of the superstructure modules 38 and the A-frame structure 40 on a typical four-level base 42 placed on the floatable box girder 6. The modular sections 38 are made up of standard beams, girders, and stanchions, with all distributed services incorporated in the decking 44. The modules 38 are preferably organized into sets of four-by-four arrays or six-by-six arrays (although other groupings are also possible). These module arrays 46 may be served by a (non-illustrated) vertical service trunk incorporated at the corner of the array.

The A-frame structure 40 preferably incorporates various widths of modules 38 and preferably also incorporates one, two or three A-frame trusses 48 (although other numbers of trusses are possible). One A-frame truss 48 would usually support a module set 46 with a transverse width of two-deck heights. In other words, two trusses 48 would be required for a four-deck weight wide set 46 of modules 38.

The superstructure base modules 38 and the superstructure frame are preferably made of standard steel sections and plates, with the modules 38 preferably being produced using an assembly line approach. This enables all of the various elements of the preferred embodiment of the invention to be constructed, and the whole structure assembled, at any major shipyard in the world.

The presently disclosed embodiments are to be considered in all respects as illustrative and not restrictive, the scope of the invention being indicated by the appended claims, rather than the foregoing description, and all changes which come within the meaning and range of equivalency of the claims are therefore intended to be embraced therein.

I claim:

1. A structure that is floatable on an ocean surface and that is fixable relative to an ocean bottom, the structure comprising:

an array of floatable column stabilized caissons, a floatable box girder configured to engage the array of caissons and to support a superstructure, means for raising and lowering the array of caissons relative to the ocean surface, means for connecting the array of caissons and the box girder, means for positioning the array of caissons on the ocean bottom, wherein the means for positioning the array of caissons on the ocean bottom comprises a skirt for establishing a void between at least one of the caissons and the ocean bottom, and means for introducing pressure equalizing and leveling material into the void, whereby the box girder is floatable to a position on the ocean surface substantially above the array of caissons, and the array of caissons can be raised toward the box girder and connected with the box girder.

2. The floatable structure of claim 1, further comprising a box caisson for connecting a plurality of the floatable caissons.

3. The floatable structure of claim 1, wherein at least some of the caissons comprise caps and wherein the box girder is configured to engage the caps of the caissons.

4. The floatable structure of claim 1, further comprising a superstructure provided on the box girder.

5. The floatable structure of claim 1, wherein the box girder defines a substantially horizontal equilibrium and further comprising means for adjusting the horizontal equilibrium of the box girder.

6. The floatable structure of claim 5, wherein the void established by the skirt is subjected to an internal pressure and wherein the means for adjusting the horizontal equilibrium of the box girder comprises means for adjusting the internal pressure of the void.

7. A method of assembling a structure that is floatable on a ocean surface and that is fixable relative to an ocean bottom, the method comprising the steps of:

providing an array of floatable column stabilized caissons, at least one of the caissons being provided with a skirt, providing a floatable box girder, lowering the array of caissons below the ocean surface, bridging the box girder to a position on the ocean surface substantially above the lowered array of caissons, raising the array of caissons toward the ocean surface to engage the box girder and lift the box girder above the ocean surface, connecting the array of caissons and the box girder, lowering the array of caissons connected to the box girder to a position at which the skirt establishes a void between at least one of the caissons and the ocean bottom, and introducing pressure equalizing and leveling material into the void.

8. The method as in claim 7, further comprising the step of providing a superstructure on the box girder.

9. The method as in claim 8, wherein the step of providing a superstructure on the box girder precedes the step of raising the array of caissons to engage the box girder.

10. The method as in claim 9, wherein the step of providing a superstructure on the box girder precedes the step of bridging the box girder to a position on the ocean surface substantially above the lowered array of caissons.

11. The method as in claim 7, wherein the step of bringing the box girder to a position on the ocean surface substantially above the lowered array of caissons comprises the step of floating the box girder on the ocean surface to a position substantially above the lowered array of caissons.

12. The method as in claim 7, wherein the box girder defines a substantially horizontal equilibrium and further comprising the step of adjusting the horizontal equilibrium of the box girder.

13. The method as in claim 12, wherein at least some of the caissons define a void having an internal pressure and wherein the step of adjusting the horizontal equilibrium of the box girder comprises the step of adjusting the internal pressure of at least some of voids.

* * * * *